US006588955B1

(12) United States Patent
Cassiano

(10) Patent No.: US 6,588,955 B1
(45) Date of Patent: Jul. 8, 2003

(54) ANTI-NOISE PLATEN OF THE FLAT TYPE FOR AN IMPACT PRINTER

(75) Inventor: Cosimo Cassiano, Vittuone (IT)

(73) Assignee: Compuprint SpA, Turin (IT)

( * ) Notice: Subject to any disclaimer, the term of this patent is extended or adjusted under 35 U.S.C. 154(b) by 48 days.

(21) Appl. No.: 09/690,384

(22) Filed: Oct. 17, 2000

(30) Foreign Application Priority Data

Oct. 18, 1999 (EP) ..... 99830656

(51) Int. Cl.[7] ..... B41J 11/08
(52) U.S. Cl. ..... 400/656; 400/689
(58) Field of Search ..... 400/656, 657, 400/658, 659, 661.3, 661.1, 661, 689

(56) References Cited

U.S. PATENT DOCUMENTS

| | | | | | |
|---|---|---|---|---|---|
| 1,994,309 | A | * | 3/1935 | Going | 400/661 |
| 4,583,272 | A | * | 4/1986 | Keller | 400/659 |
| 4,597,682 | A | * | 7/1986 | Rooney | 400/656 |
| 4,957,382 | A | * | 9/1990 | Delaney et al. | 400/656 |
| 5,613,789 | A | * | 3/1997 | Sugai | 400/661 |
| 5,816,724 | A | | 10/1998 | Hada et al. | 400/656 |
| 5,879,091 | A | * | 3/1999 | De Ambrogio et al. | 400/656 |
| 6,036,380 | A | * | 3/2000 | Astroth et al. | 400/23 |
| 6,394,672 | B1 | * | 5/2002 | Murray et al. | 400/58 |

FOREIGN PATENT DOCUMENTS

| | | | | |
|---|---|---|---|---|
| EP | 0 084 630 A1 | | 8/1983 | |
| EP | 0 431 925 A1 | | 6/1991 | |
| EP | 0 593 293 A2 | | 4/1994 | |
| JP | 61229579 | | 10/1986 | |
| JP | JA-0162570 | * | 7/1987 | 400/661.2 |
| JP | JA-0049668 | * | 2/1989 | 400/656 |
| JP | 01047569 | | 2/1989 | |

* cited by examiner

*Primary Examiner*—Ren Yan
*Assistant Examiner*—Anthony H. Nguyen
(74) *Attorney, Agent, or Firm*—Akin Gump Strauss Hauer & Feld, L.L.P.

(57) ABSTRACT

A platen (115) of the flat type for an impact printer comprising a metal body (220) for support and a plastics body (222) for protection and absorption of vibrations, in which the metal body (220) is completely embedded in the plastic body (222).

10 Claims, 2 Drawing Sheets

ANTI-NOISE PLATEN OF THE FLAT TYPE FOR AN IMPACT PRINTER

FIELD OF THE INVENTION

The present invention relates to a platen of the flat type for an impact printer.

BACKGROUND OF THE INVENTION

In impact printers, such as serial dot matrix printers, the print is obtained by means of impression elements (in this case needles) arranged on a print head; the needle act on an inked ribbon and are pushed hard against a sheet of paper that is supported on a printing platen.

In one particular category of impact printers, the platen is of the flat type. In this case the platen generally consists of a metal section, giving a high accuracy of manufacture; this ensures that the head is maintained at a correct distance from a free surface of the sheet of paper upon which the needles act. A strip of plastics material is glued to a surface of the metal section on which the sheet of paper is supported; this plastics strip acts as a support for the sheet of paper, so as not to damage the needles and the inked ribbon. Two strips of anti-noise material (made for example of a lead-based material) are glued to corresponding lateral surfaces of the metal section, to reduce the vibrations and the noise produced during printing. Moreover, in the case when the platen is not fixed rigidly to a frame of the printer, two blocks of plastics material are 25 provided, screwed to the longitudinal ends of the metal section, each of which is connected to a corresponding elastic support; these connecting blocks reduce the vibrations transmitted from the platen to the frame of the printer.

A drawback with known platens is that the operations of gluing of the plastics strip and of the anti-noise strips to the metal section (and the operations of screw-fixing of the connecting blocks if required) introduce inaccuracies in assembly; therefore it is necessary to provide a subsequent stage of correction of the platen.

This correction stage, combined with the operations of gluing of the plastics strip and of the anti-noise strips (and with the possible operations of screw-fixing of the connecting blocks) make the platen extremely expensive, which affects the final cost of the whole printer.

Furthermore, management of the various components of the platen (metal section, plastics strip, anti-noise strips and connecting blocks if present) introduces significant logistical difficulties in management of the various suppliers.

SUMMARY OF THE INVENTION

The object of the present invention is to overcome the abovementioned drawbacks. To achieve this object, a platen of the flat type for an impact printer as described in the first claim is proposed.

Briefly, there is provided a platen of the flat type for an impact printer comprising a metal body for support and a plastics body for protection and absorption of vibrations wherein the metal body is embedded in the plastics body.

Furthermore, the present invention also proposes an impact printer comprising the said platen and a corresponding method of manufacture of the platen.

BRIEF DESCRIPTION OF THE DRAWINGS

Further features and the advantages of the platen of the flat type for an impact printer according to the present invention will appear in the following description of a preferred embodiment thereof, given purely by way of a non-restrictive indication, with reference to the accompanying drawings, in which.

DESCRIPTION OF A PREFERRED EMBODIMENT

Figure 1:
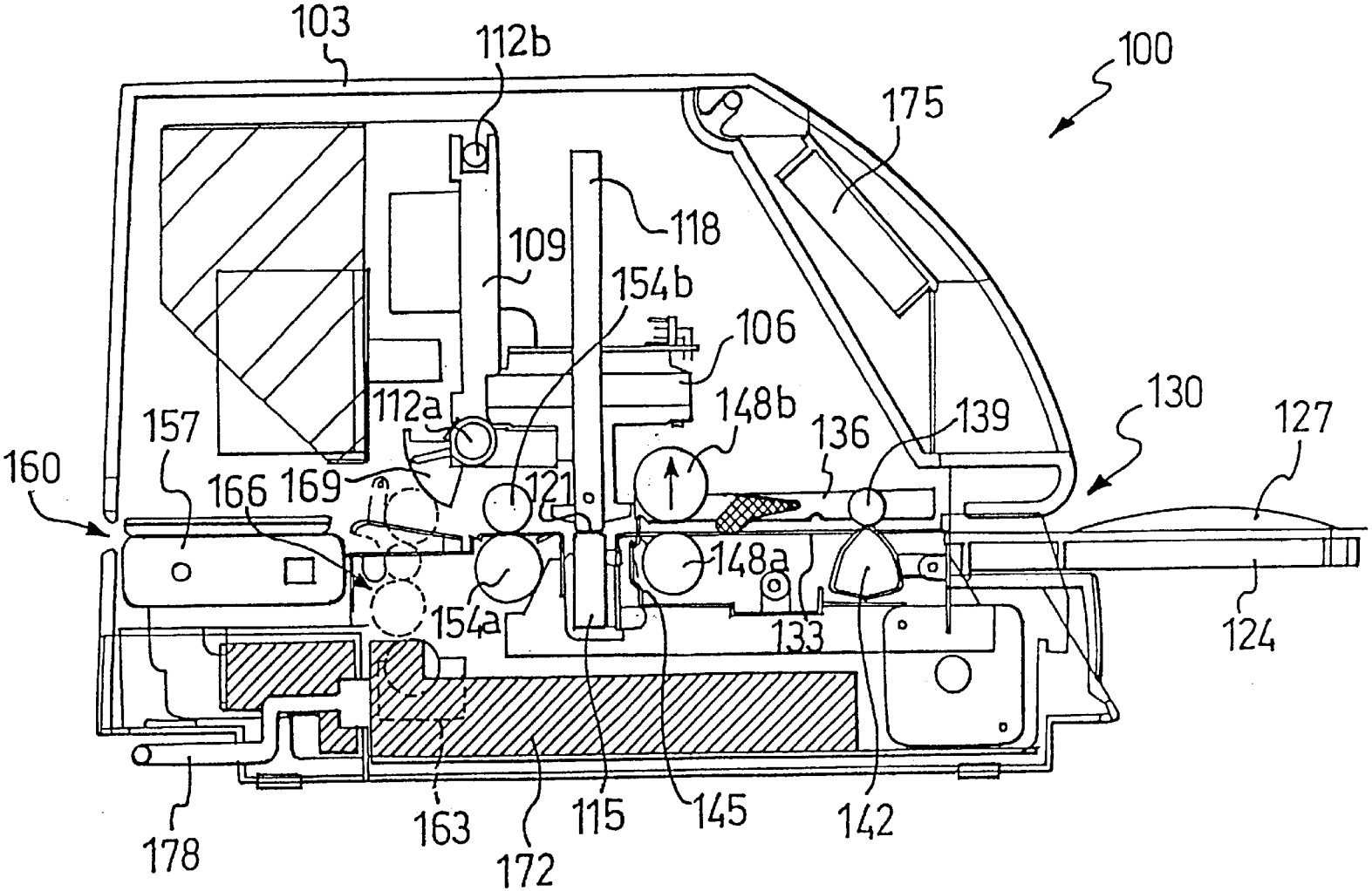
FIG. 1 is a schematic section drawing of an example of an impact printer in which the platen of the present invention can be used.

Referring in particular to FIG. 1, a serial impact printer 100 is shown, for teller applications, for example of the bank teller type. The printer 100 is provided with a mechanical supporting frame 103; inside the frame 103 there is a print head 106 equipped with a matrix of needles (not shown in the figure). The head 106 is supported by a carriage 109 sliding on two guide bars 112*a* and 112*b*.

The needles of head 106 are opposite a printing platen 115 parallel to the guide bars 112*a*, 112*b*. As described in detail below, platen 115 is of the flat type (non-rotating), and is connected elastically to frame 103. A cartridge of inked ribbon 118 is arranged in such a way that a portion of the inked ribbon is interposed between the needles of head 106 and platen 115. The movement of head 106 defines a printing line 121 on platen 115.

A supporting platform 124 is hinged externally onto frame 103. A passbook 127 is placed on platform 124 and is inserted manually through a front slit 130. The passbook 127 is inserted between a chute 133 and a thickness detecting device 136. A series of rollers 139, resting against a locating element 142, align the passbook 127 with a back perpendicular to the printing line 121. The passbook is in addition pressed against a stopper 145, consisting for example of a series of teeth projecting towards the top of chute 133.

Once the passbook 127 is aligned, the stopper 145 is lowered; a pair of sets of friction rollers 148*a*, 148*b* then feed the passbook 127 towards the printing line 121. The passbook 127 is conveyed to the printing line 121 between head 106 (and the associated inked ribbon 118) and platen 115. The passbook 127 is advanced with an intermittent motion; each time that passbook 127 is motionless, head 106 traverses the printing line 121 (alternately in the two directions) so as to print several lines (of characters or of a graphics image) successively on passbook 127. The passbook is then moved along by another pair of sets of friction rollers 154*a*, 154*b* arranged downstream of the printing line 121.

Once a printing operation has ended, the sense of rotation of the sets of rollers 148*a*, 148*b* and 154*a*, 154*b* is reversed, so as to return the passbook 127 to the front slit 130; passbook 127 is then ejected by rollers 139, which misalign the passbook 127 as a visual indication to an operator that the printing operation has ended.

The printer 100 also includes a pair of tractors 157 that are used for feeding a fanfold (not shown in the drawing), inserted through a rear slit 160. Towards the printing line 121.

The printer 100 is equipped with an automatic gap adjustment (AGA) system. The AGA system includes an electric motor 163 which raises or lowers, by means of a series of gears 166 connected to a cam system 169, the head 106 relative to the platen 115, to position it at a correct distance.

Operation of printer 100 is controlled by a microprocessor-based control logic system 172 in response to commands entered by a user via an external panel 175 or supplied by a processing system (not shown in the drawing) via a suitable cable connected to an interface connector 178.

During the operation of printing the passbook 127, its thickness is detected continuously by device 136 (before passbook 127 reaches the printing line 121). On the contrary, when a new fanfold is loaded into the printer and is fed to the printing line 121, a single needle of head 106 is shot against the fanfold and the thickness of the fanfold is calculated as a function of the time for rebound of the needle. In both cases, control logic system 172 alters (by means of the AGA system 163–169) the distance of head 106 from platen 115 on the basis of the thickness detected.

Similar considerations apply when the serial dot matrix printer is used in other applications (for example insurance), has a different structure, for example is equipped with cassettes for automatic single sheet feed, with other means of feed, or the platen is fixed rigidly to the frame of the printer, etc.; alternatively, a printer of the parallel type is envisaged, or a daisywheel printer, inkjet printer, or more generally any impact printer.

Figure 2:
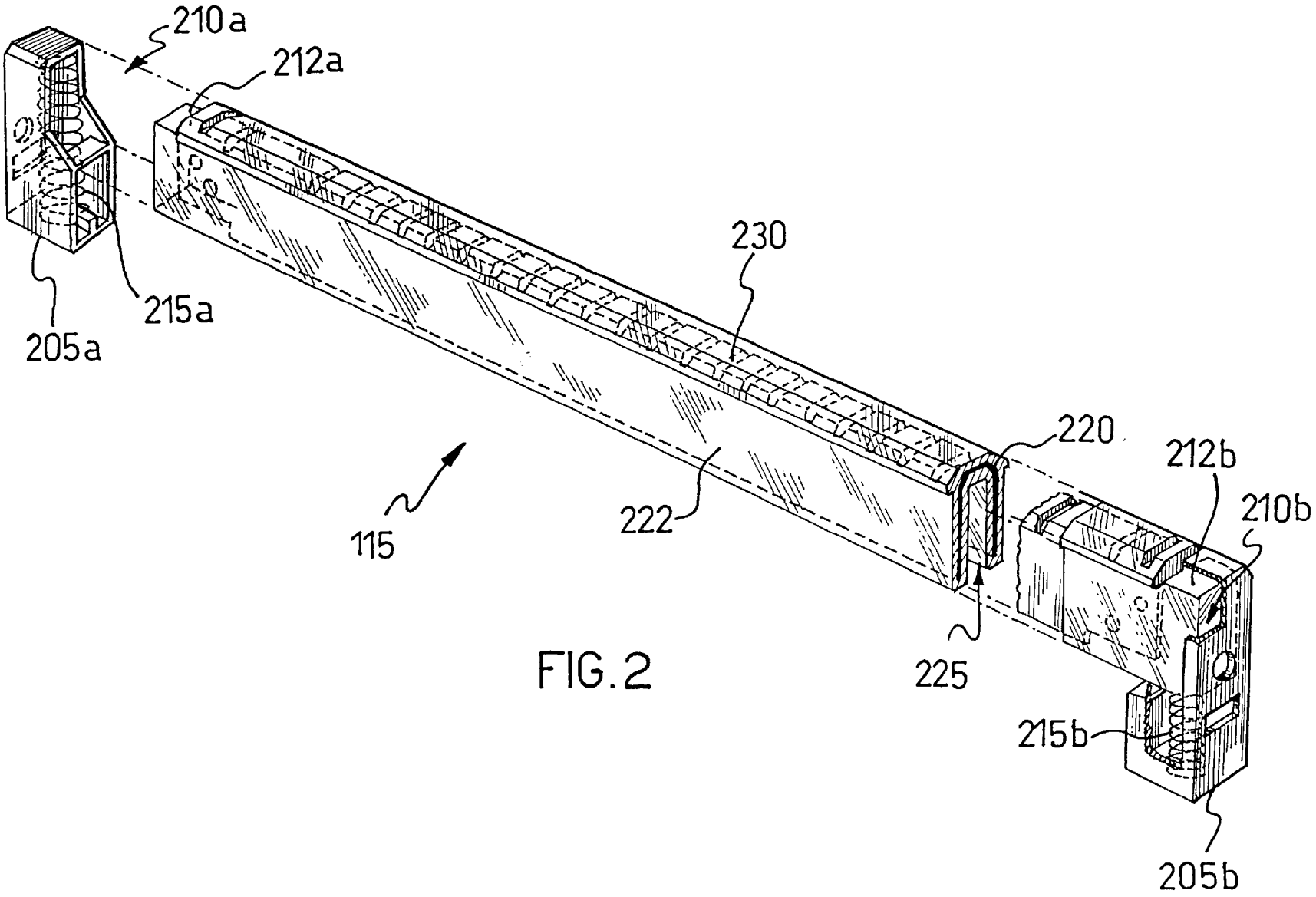
FIG. 2 is a perspective view of the platen.

Referring now to FIG. 2, platen 115 is connected to the printer frame by two elastic support elements, each of which has a base 205*a*, 205*b* (generically of parallelepiped shape) made of rigid plastics material. On an inside wall of the base 205*a*, 205*b*, a cavity 210*a*, 210*b* is provided for accommodating a corresponding longitudinal end portion 212*a*, 212*b* of platen 115. A seating for a helical spring 215*a*, 215*b* is opened in a lower wall of cavity 210*a*, 210*b*. When the end portions 212*a*, 212*b* of platen 115 are inserted in cavities 210*a*, 210*b*, the springs 215*a*, 215*b* push the platen 115 upwards, in such a way that the end portions 212*a*, 212*b* of platen 115 are pressed against an upper wall of cavities 210*a*, 210*b*.

Platen 115 comprises a metallic supporting body 220 and a plastics body 222 for protecting the metallic body 220 and for absorbing vibrations. In platen 115 of the present invention, the metal body 220 is embedded in the plastics body 222.

This type of structure does not require any subsequent operation of assembly (gluing or screw fitting); this makes it possible to obtain high accuracy, of the order of 1–2% (without requiring any correction stage). This solution proves particularly advantageous in the type of impact printer described above (though use in other printers is not excluded). In that case, in fact, the gap between the head and the platen is regulated (by means of the AGA system) as a function of the passbook thickness detected upstream of the printing line (so that the printing speed is not affected in any way); however, this requires very high accuracy of the platen (in contrast to cases in which a thickness sensor, consisting of a lever ending in a wheel that is pressed against the platen, is incorporated in the head).

The solution described above gives a dramatic reduction in the cost of manufacture of the platen and simplifies logistic management of suppliers. In particular, in the case shown in the drawing, where the platen is connected elastically to the printer frame, there is no longer any need for the operations of gluing of the plastics strip and of the anti-noise strips, or for the operation of screw-fitting of the connecting blocks; this leads to a reduction in cost of manufacture of the platen of approx. 70%. The solution of the present invention is however also suitable for use in the case when the platen is fixed rigidly to the printer frame (for example by screws through holes made in the metal body); in this situation, only the operations of gluing of the plastics strip and of the anti-noise strips are eliminated, with a reduction in platen manufacturing cost of approx. 50%.

The plastics body 222 covers the metal body 220 completely (though it is also possible for part of the metal body to project from the plastics body). In this way, no part of the metal body 220 is exposed to the air, so no finishing operation is required (such as galvanizing) to protect the metal body 220 against oxidation.

In the particular embodiment illustrated in the drawing, the metal body 220 consists of a steel section, obtained extremely economically by a process of rolling, bending and trimming. Metal body 220 has a general U transversal section; in particular, a central wall is provided, from which two lateral walls extend perpendicularly, so as to define a longitudinal channel 225 between the two lateral walls. The central wall of the metal body 220 has a front surface disposed in front of the printing line 121. Slots 230 (for example several dozen) are made in the central wall, each slot being arranged transversely to a longitudinal axis of the metal body 220.

The plastics body 222 is made of polyurethane, with a hardness, measured with a shore hardness tester, between 90 Sh D and 106 Sh D, for example 105 Sh D. The plastics body 222, embedding the metal body 220, defines an impact layer on the front surface of the central wall of the metal body 220. The thickness of such impact layer is preferably comprised between 0.5 and 5 mm. In such a manner, the impact surface of platen 115, on which the passbook or the fanfold (or any other printing substrate) is placed, offers good support for the printing substrate while at the same time being sufficiently soft (so as not to damage the needles and the inked ribbon) and elastic (so as not to be deformed permanently by the needles).

The length of the metal body 220 is less than that of the plastics body 222, therefore the plastics body 222 extends beyond the longitudinal ends of the metal body 220 (for example by approx. 1 cm). Thus, the metal body 220 does not reach the end portions 212*a*, 212*b* of platen 115; these end portions 212*a*, 212*b* (which are inserted in cavities 210*a*, 210*b* to couple the platen 115 to the elastic support elements 205*a*–215*a*, 205*b*–215*b*) are therefore made of plastics material completely. Moreover, in the preferred embodiment of the present invention shown in the drawing, the plastics body 222 completely fills the longitudinal channel 225. These arrangements permit very considerable reduction in vibrations of platen 115.

Alternatively, the metal body is made of aluminium, has a different shape, the plastics body is made of some other equivalent material, has a different hardness, extends to a different extent beyond the longitudinal ends of the metal body or has a length substantially the same as that of the metal body, does not fill the longitudinal channel, etc.

Platen 115 is made by an injection moulding process. In particular, the metal body 220 is placed in a suitable mould. A thermoplastic resin, heated to the plastic state, is injected at high pressure into the mould (which is first closed), near the central wall of metal body 220. The resin fills the mould completely, passing through the slots 230 of metal body 220. Once the resin has solidified as a result of cooling, the mould is opened and platen 115 is removed.

This method is especially advantageous in that it makes it possible to obtain a very thin layer of plastics material around the metal body (of the order of a few mm) so as to reduce the extent of deformations of the platen (in the vicinity of the printing line) due to moisture absorbed by the plastics body. Furthermore, once the cost of the mould has been written off, the injection moulding process is very economical, with large savings when the platen is mass produced. Alternatively, the slots are arranged differently or the metal body is not provided with any slots, a casting process is used, etc.

Obviously, a person skilled in the art could make numerous changes and variations to the platen of the flat type for an impact printer as described above, in order to satisfy additional and specific requirements, all however falling within the scope of protection of the invention, as defined by the following claims.

What is claimed is:

1. A platen for an impact printer comprising:

a metal body including:

a bar having a substantially U-shaped transversal section which defines a central wall, the central wall forming a substantially flat surface, the central wall having a first and a second side;

two lateral walls extending perpendicularly from said central wall; and a longitudinal channel disposed between said two lateral walls, a plastic body entirely encasing the metal body, said plastic body filling said longitudinal channel, and a portion of the plastic body of generally uniform thickness disposed on the first side of the central wall, the first side of the central wall and the portion of the plastic body disposed thereon together forming a substantially flat impact surface, the platen being disposed within the impact printer such that a printing element of the impact printer strikes the impact surface.

2. A platen according to claim 1, wherein the portion of the plastic body disposed on the first side of the central wall has a thickness comprised between 0.5 and 5 mm, to softly and elastically support any printing substrate.

3. A platen according to claim 1, wherein a plurality of through slots is provided in said central wall for lodging corresponding portions of said plastic body.

4. A platen according to claim 1, wherein said metal supporting body is made of steel and said plastic body is made of polyurethane with a hardness between 90 Sh D and 106 Sh D.

5. A platen according to claim 1, wherein said plastic body is made by an injection molding process.

6. A platen according to claim 1 positioned within an impact printer.

7. A platen according to claim 1, further comprising elastic support means for said platen, wherein said plastic body has a determined length and at least a first and a second longitudinal end portion, wherein said metal body is shorter than said determined length of said plastic body so as not to reach said first and second longitudinal end portions of said plastic body, and wherein said platen is connected to said elastic support means by said first and second longitudinal end portions of said plastic body.

8. A method for manufacturing a platen according to claim 1 for an impact printer, comprising the step of providing the metal body and a step of completely embedding said metal body in said plastic body for protection and for absorption of vibrations produced by said impact printer.

9. A method according to claim 8, wherein said step of embedding said metal body in said plastic body is performed by an injection molding process.

10. A method according to claim 9, wherein said injection molding process comprises the steps of placing said metal body in a mold and injecting a material in a plastic state into said mold to cover said metal body, wherein said metal body comprises the bar having the substantially U-shaped transversal section so as to define the central wall from which the two lateral walls extend perpendicularly, and wherein a plurality of slots is provided in said central wall for allowing the passage of said material in the plastic state.

* * * * *